US012352532B2

(12) United States Patent
Liu et al.

(10) Patent No.: US 12,352,532 B2
(45) Date of Patent: Jul. 8, 2025

(54) AIMING DEVICES AND METHODS THEREOF

(71) Applicants: Sintai Optical (Shenzhen) Co., Ltd., ShenZhen (CN); Asia Optical Co., Inc., Taichung (TW)

(72) Inventors: Hua-Tang Liu, Taichung (TW); Peng-Chen Chang Chien, Taichung (TW)

(73) Assignees: SINTAI OPTICAL (SHENZHEN) CO., LTD., Shenzhen (CN); ASIA OPTICAL CO., INC., Taichung (TW)

( * ) Notice: Subject to any disclaimer, the term of this patent is extended or adjusted under 35 U.S.C. 154(b) by 0 days.

(21) Appl. No.: 18/623,126

(22) Filed: Apr. 1, 2024

(65) Prior Publication Data

US 2024/0361104 A1 Oct. 31, 2024

(30) Foreign Application Priority Data

Apr. 25, 2023 (CN) ..... 202310467320.7

(51) Int. Cl.
*F41G 3/06* (2006.01)
*F41G 3/12* (2006.01)

(52) U.S. Cl.
CPC *F41G 3/06* (2013.01); *F41G 3/12* (2013.01)

(58) Field of Classification Search
CPC ..... F41G 3/06; F41G 3/12
USPC ..... 235/404
See application file for complete search history.

(56) References Cited

U.S. PATENT DOCUMENTS

| | | | | |
|---|---|---|---|---|
| 9,482,489 | B2 | 11/2016 | Peters et al. | |
| 2012/0180366 | A1* | 7/2012 | Jaroh | F41G 3/165 42/114 |
| 2016/0231083 | A1* | 8/2016 | Regan | F41G 3/06 |
| 2024/0219147 | A1* | 7/2024 | Wang | G01P 3/36 |

FOREIGN PATENT DOCUMENTS

| | | | |
|---|---|---|---|
| CN | 107830764 | A | 3/2018 |
| TW | 1429875 | B | 3/2014 |

* cited by examiner

*Primary Examiner* — Daniel A Hess
(74) *Attorney, Agent, or Firm* — McClure, Qualey & Rodack, LLP

(57) ABSTRACT

Aiming devices and methods thereof are provided. First, a ranging unit is used to perform a ranging operation on an object to obtain a corresponding object distance. Then, a plurality of compensation positions are displayed on a display unit of an aiming device, and a ballistic compensation program is used to calculate a target position among the compensation positions according to the object distance. When the aiming device moves, the number of the compensation positions displayed on the display unit will be changed. It is to determine whether the aiming device is located at the target position. When the aiming device is at the target position, the display unit will only display the target position among the compensation positions or no longer performs the compensation.

20 Claims, 7 Drawing Sheets

AIMING DEVICES AND METHODS THEREOF

BACKGROUND OF THE INVENTION

Field of the Invention

The disclosure relates generally to aiming devices and methods thereof, and, more particularly to aiming devices and methods thereof that can utilize ranging results of a ranging unit and provide an aiming guidance mechanism.

Description of the Related Art

Recently, laser rangefinders have replaced traditional ranging methods and become the mainstream of ranging systems. Laser rangefinders can be used in many applications. For example, land measurement and golf course measurement of club distances to assist users in selecting appropriate clubs. On the other hand, shooting devices such as crossbows and firearms are also used in conjunction with sighting scopes and laser rangefinders to increase aiming accuracy.

In a conventional technology, the sighting scope and the rangefinder are separate and independent. Under such a design, the user must recalibrate the offset for the first time or when the relative position of the sighting scope and rangefinder is moved. The user must first align the center of the sighting scope with the target, and then use the rangefinder to measure the distance. The user then determines the ballistic trajectory and which crossbow needle needs to be used to aim at the target. The conventional technology lacks the function of automatically calculating trajectory and guiding it to the optimal position.

Since during the use of shooting devices, such as crossbows, calculating ballistic compensation at different distances has a great impact on shooting accuracy. In order to allow crossbow users to accurately and quickly aim at the target and shoot, it can be a good improvement if the time of calculating ballistic compensation due to the influence of distance can be saved.

BRIEF SUMMARY OF THE INVENTION

In an embodiment of an aiming device includes a display unit, a ranging unit, and a processing unit. The ranging unit performs a ranging operation on an object to obtain a corresponding object distance. The processing unit displays a plurality of compensation positions on the display unit, and uses a ballistic compensation program to calculate a target position among the compensation positions based on the object distance. When the aiming device moves, the number of compensation positions displayed on the display unit will be changed, and the processing unit determines whether the aiming device is located at the target position. When the aiming device is at the target position, the processing unit will only display the target position among the compensation positions on the display unit or no longer performing the compensation via the display unit.

In an embodiment of an aiming device includes a display unit, a ranging unit, and a processing unit. The ranging unit performs a ranging operation on an object to obtain a corresponding object distance. The processing unit displays a plurality of compensation positions on the display unit, and uses a ballistic compensation program to calculate a target position among the compensation positions based on the object distance. When the aiming device moves, the number of compensation positions displayed on the display unit will be changed, and the processing unit determines whether the aiming device is located at the target position. When the aiming device is at the target position, the display unit no longer corrects for compensation.

In an embodiment of an aiming method. First, a ranging unit is used to perform a ranging operation on an object to obtain a corresponding object distance. Then, a plurality of compensation positions are displayed on a display unit of an aiming device, and a ballistic compensation program is used to calculate a target position among the compensation positions according to the object distance. When the aiming device moves, the number of the compensation positions displayed on the display unit will be changed, and it is determined whether the aiming device is located at the target position. When the aiming device is at the target position, the display unit will only display the target position among the compensation positions.

In an embodiment of an aiming method. First, a ranging unit is used to perform a ranging operation on an object to obtain a corresponding object distance. Then, a plurality of compensation positions are displayed on a display unit of an aiming device, and a ballistic compensation program is used to calculate a target position among the compensation positions according to the object distance. When the aiming device moves, the number of the compensation positions displayed on the display unit will be changed, and it is determined whether the aiming device is located at the target position. When the aiming device is at the target position, the display unit no longer corrects for compensation.

In some embodiments, each of the compensation positions has a plurality of different distance values from a center line of the display unit. When the aiming device is located at the target position, an aiming confirmation message is generated through the aiming device.

In some embodiments, when the aiming device is at the target position, the aiming confirmation message generated by the aiming device includes lighting an optimal compensation position among the compensation positions and the corresponding object distance. A shooting device includes a crossbow, and the aiming device is a laser rangefinder detachably fixed on the crossbow.

In some embodiments, the method of determining whether the aiming device is located at the target position is to use a ballistic compensation program to calculate a launch angle based on the object distance, a shooting velocity of a corresponding shooting device, and a gravity. The aiming device is used to be fixed on the shooting device. Then, an angle detector is used to detect the inclination angle of the aiming device and it is determined whether the inclination angle matches the launch angle. When the inclination angle matches the launch angle, it is determined that the aiming device is at the target position.

In some embodiments, when the aiming device is not at the target position, a guidance prompt message is generated through the aiming device based on the inclination angle and the launch angle to guide the inclination angle of the aiming device to change.

In some embodiments, the aiming device is used to receive a confirmation instruction of the corresponding object, and the object distance of the object is determined in response to the confirmation instruction. The confirmation instruction is received by pressing a button on the aiming device, or by the aiming device wirelessly from a remote control.

In some embodiments, a plurality of candidate shooting velocities of corresponding plurality of candidate firing devices are provided in the aiming device, and one of the candidate firing devices is selected to determine the corresponding shooting velocity for use in the calculation of the launch angle in the ballistic compensation program.

Aiming methods may take the form of a program code embodied in a tangible media. When the program code is loaded into and executed by a machine, the machine becomes an apparatus for practicing the disclosed method.

BRIEF DESCRIPTION OF THE DRAWINGS

The invention will become more fully understood by referring to the following detailed description with reference to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. It should be understood that the embodiments may be realized in software, hardware, firmware, or any combination thereof.

Figure 1:
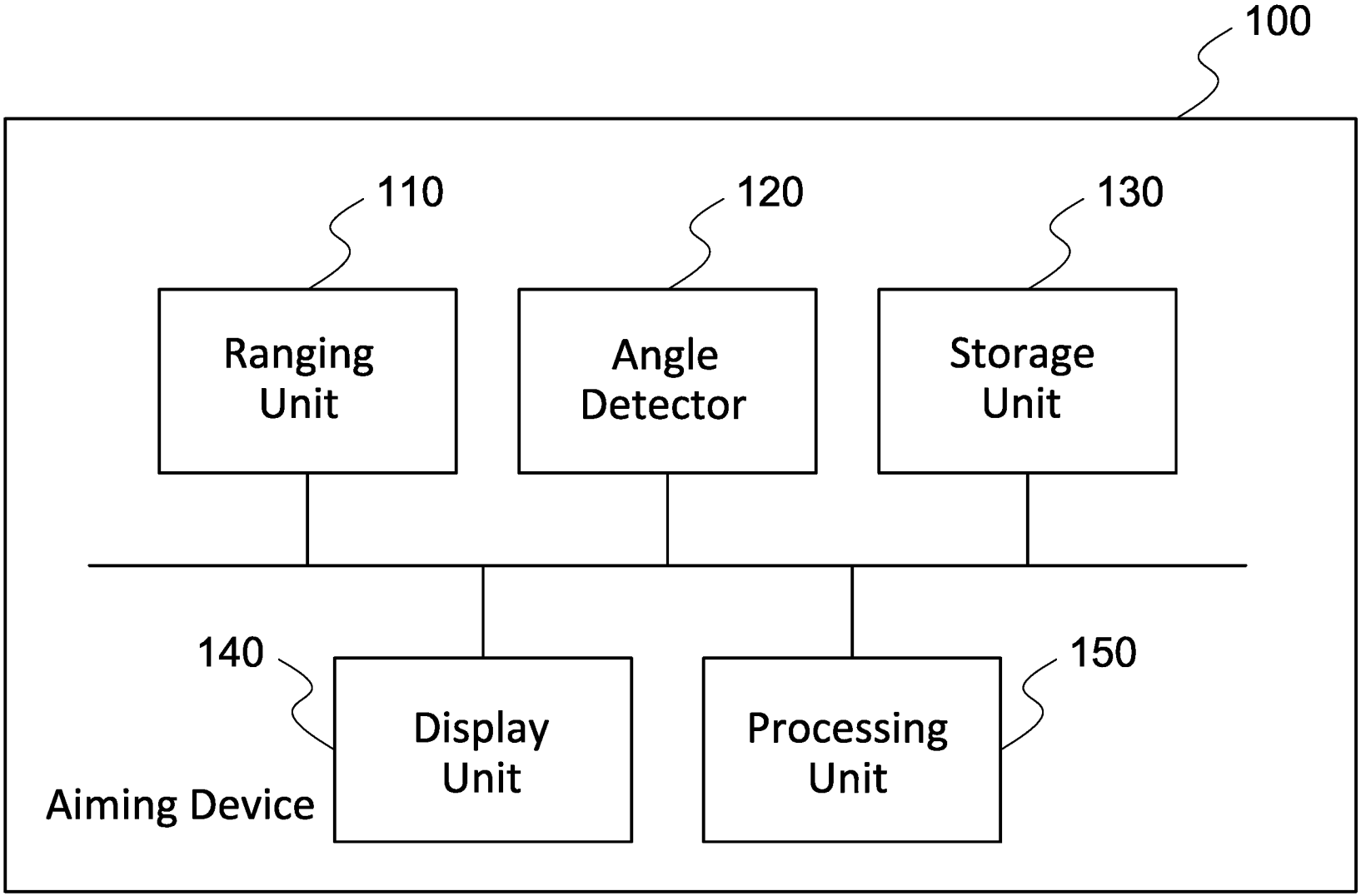
FIG. 1 is a schematic diagram illustrating an embodiment of a shooting device of the invention.
Figure 2:
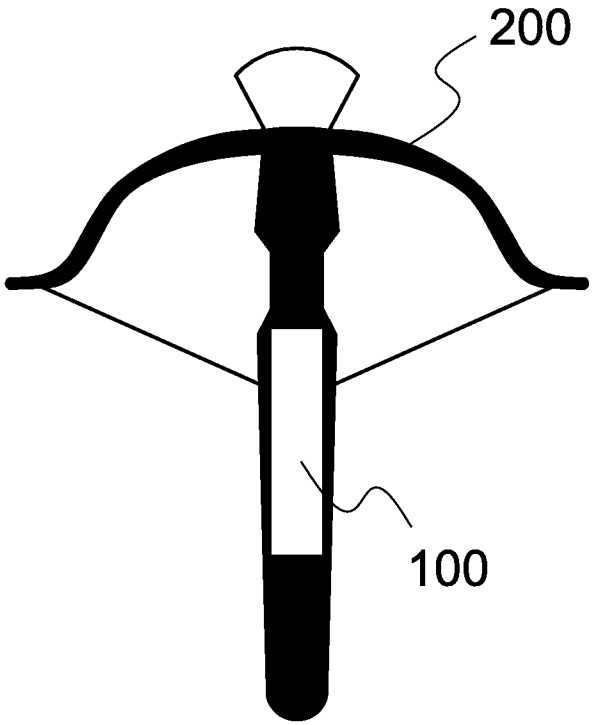
FIG. 2 is a schematic diagram illustrating an embodiment of a shooting device and an aiming device of the invention.
Figure 3:
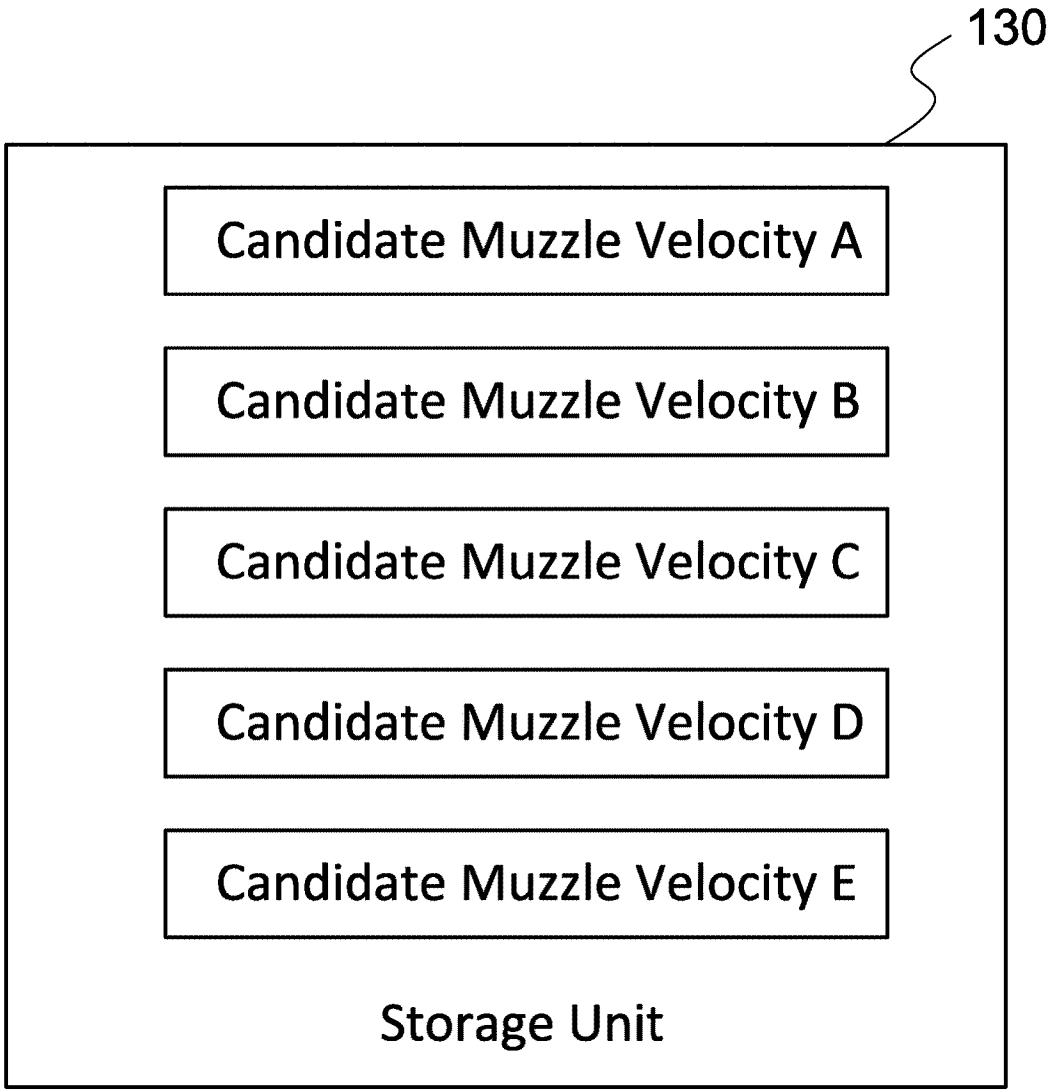
FIG. 3 is a schematic diagram illustrating an embodiment of a storage unit of the invention.

FIG. 1 shows an aiming device according to an embodiment of the present invention. The aiming device 100 according to the embodiment of the present invention comprises a ranging unit 110, an angle detector 120, a storage unit 130, a display unit 140, and a processing unit 150. In some embodiments, the ranging unit 110 may be a laser ranging module, which may include a transmitting module and a receiving module. The transmitting module can emit a measurement beam, and the measurement beam is reflected from a target object in the environment to the receiving module. The distance between the ranging unit 110 and the target object is calculated using a ranging formula based on the time of emitting laser light and the time of receiving reflected laser light. The angle detector 120 can detect an inclination angle of the aiming device 100. In some embodiments, the aiming device 100 may be detachably mounted on a shooting device, such as a pistol or a crossbow. For example, FIG. 2 shows a shooting device and an aiming device according to embodiments of the present invention. As shown in FIG. 2, the shooting device is a crossbow 200, and the aiming device 100 can be a laser rangefinder detachably fixed on the crossbow 200. As mentioned above, the angle detector 120 can detect the inclination angle of the aiming device 100. When the aiming device 100 is fixed on the shooting device, that is, the angle detector 120 can be used to detect the inclination angle of the shooting device. The storage unit 130 can store relevant data required by the processing unit 150 when performing the aiming method of the present invention. In some embodiments, the storage unit 130 may have candidate muzzle velocities, which are be displayed in FPS (Feet Per Second) corresponding to different shooting devices. For example, the storage unit 130 may have built-in candidate muzzle velocities (A, B, C, D, E) corresponding to a plurality of shooting devices, as shown in FIG. 3. The use of candidate muzzle velocities corresponding to different shooting devices will be discussed later. It should be noted that, in some embodiments, the corresponding muzzle velocity of a specific shooting device can be determined in advance before the device leaves the factory. Therefore, in some embodiments, the storage unit 130 may only record a muzzle velocity. In other words, the user or the device itself does not need to select a specific muzzle velocity when operating the aiming device. The display unit 130 can be used to display relevant information. The processing unit 150 can perform the aiming method of the present invention, the details of which will be described later.

Figure 4:
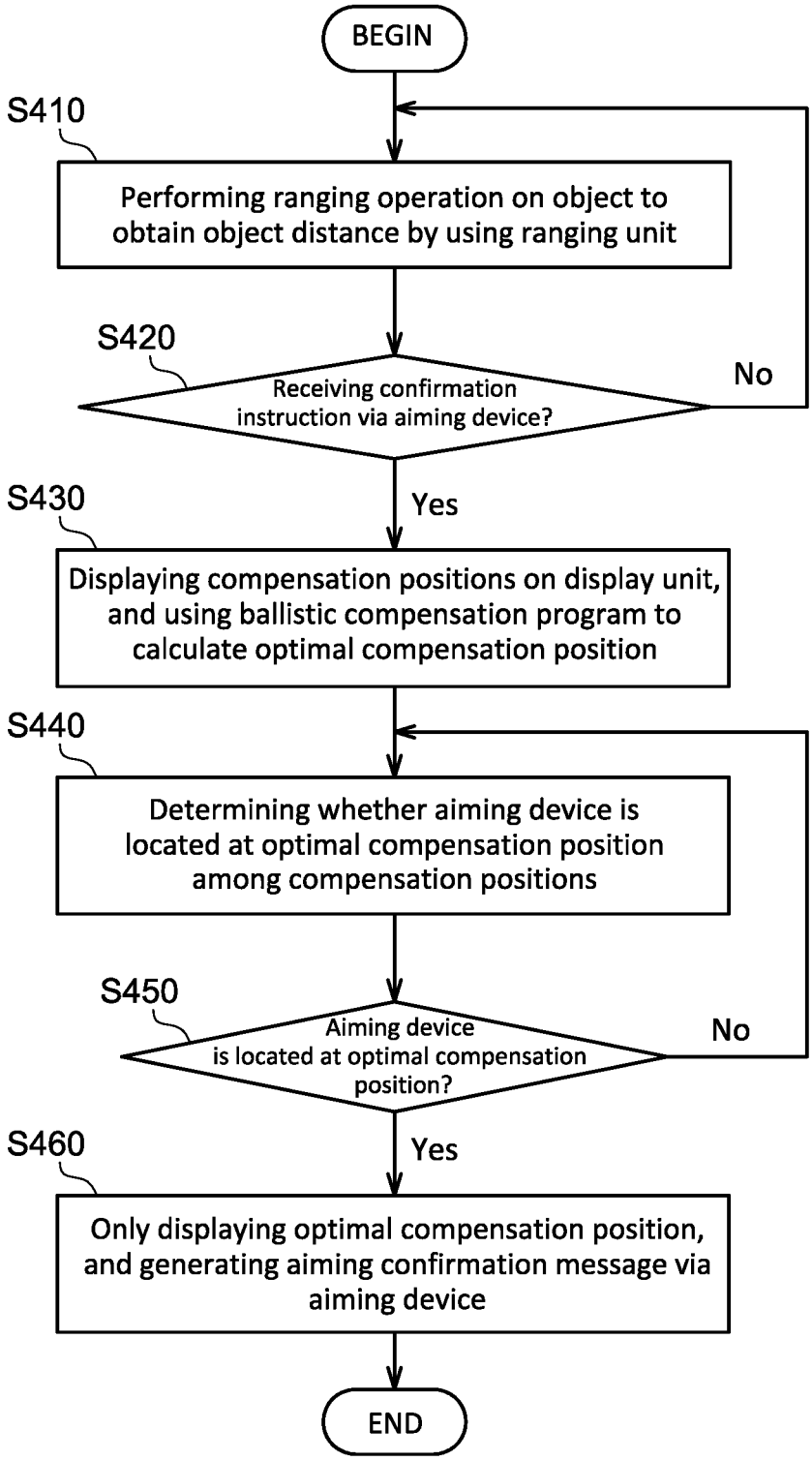
FIG. 4 is a flowchart of an embodiment of an aiming method of the invention.

FIG. 4 shows an aiming method according to an embodiment of the present invention. The aiming method according to the embodiment of the present invention is applicable to the aiming device as shown in FIG. 1. It is noted that, the aiming device can be detachably fixed on a shooting device.

First, in step S410, a ranging unit is used to perform a ranging operation on an object to obtain an object distance from the ranging unit/aiming device to the object. As mentioned above, in some embodiments, the ranging unit can be a laser ranging module, a transmitting module of the laser ranging module can emit a measurement beam, and the measurement beam can be reflected from a target object to a receiving module of the laser ranging module. Based on the time of emitting laser light and the time of receiving reflected laser light, a distance measurement formula can be used to calculate the distance between the ranging unit and the target object. In step S420, it is determined whether the aiming device receives a confirmation instruction. It is noted that, since the aiming device can aim at any target in the environment, the purpose of the confirmation instruction is to indicate that the aiming device is indeed aiming at this specific object. It is understood that, in some embodiments, the confirmation instruction may be received by pressing a button on the aiming device. In some embodiments, the confirmation instruction may be received wirelessly from a remote control by the aiming device. It should be noted that, the aforementioned method of receiving the confirmation instruction is only examples, and the present invention is not limited thereto. The object distance can be determined in response to the receipt of the confirmation instruction. When the aiming device does not receive the confirmation instruction (No in step S420), the operation of step S410 is continued. When the aiming device receives the confirmation instruction (Yes in step S420), in step S430, a plurality of compensation positions are displayed on the display unit, and a ballistic compensation program is used to calculate a target position, or called the optimal compensation position among the compensation positions based on the object distance. It should be noted that, in some embodiments, the compensation positions may have a plurality of different distance values from a center line of the display unit. It is worth noting that, in some embodiments, the target position/optimal compensation position can be calculated using a ballistic compensation program based on the object distance from the ranging unit/aiming device to the object, the muzzle velocity of the shooting device, and a gravity. As mentioned above, the aiming device is detachably fixed on the shooting device. Then, in step S440, it is determined whether the aiming device is located at the target position/optimal compensation position among the compensation positions. When the aiming device is not located at the target position/optimal compensation position among the compensation positions (No in step S450), the process returns to step S440. When the aiming device is located at the target position/optimal compensation position among the compensation positions (Yes in step S450), in step S460, the display unit will only display the target position/optimal compensation position among the compensation positions or no longer performs the compensation, and an aiming confirmation message is generated via the aiming device. It is noted that, in some embodiments, the aiming confirmation message is used to indicate that the aiming device has correctly aimed at the object. In some embodiments, the aiming confirmation message may include the lighting of the optimal compensation position and the corresponding object distance. It is understood that, in some embodiments, when the aiming device is in the target position/optimal compensation position, the display unit no longer performs the correction/compensation.

Figure 5:
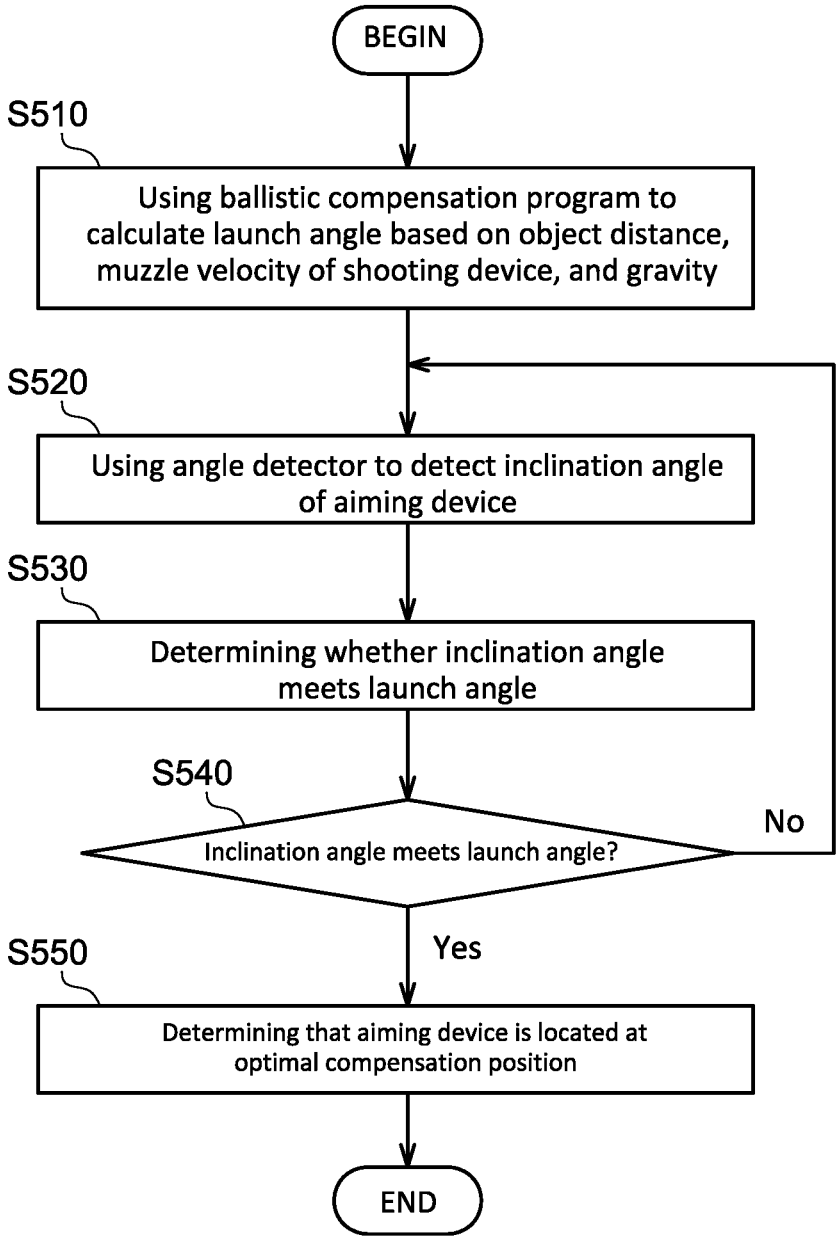
FIG. 5 is a flowchart of another embodiment of an aiming method of the invention.

FIG. 5 shows an aiming method according to another embodiment of the present invention. The aiming method according to the embodiment of the present invention is applicable to the aiming device as shown in FIG. 1. In this embodiment, through the detection of the inclination angle, it can be determined whether the aiming device is located at the target position/best compensation position among the compensation positions.

First, in step S510, a ballistic compensation program is used to calculate a launch angle based on the object distance from the ranging unit/aiming device to the object, a muzzle velocity of the shooting device, and a gravity. In step S520, an angle detector is used to detect an inclination angle of the aiming device. It should be noted that, when the aiming device is fixed on the shooting device, that is, the angle detector is used to detect the inclination angle of the shooting device. In step S530, it is determined whether the inclination angle meets the launch angle. When the inclination angle does not meet the launch angle (No in step S540), the process returns to step S520. When the inclination angle meets the launch angle (Yes in step S540), in step S550, it is determined that the aiming device is located at the target position/optimal compensation position among the compensation positions.

Figure 6:
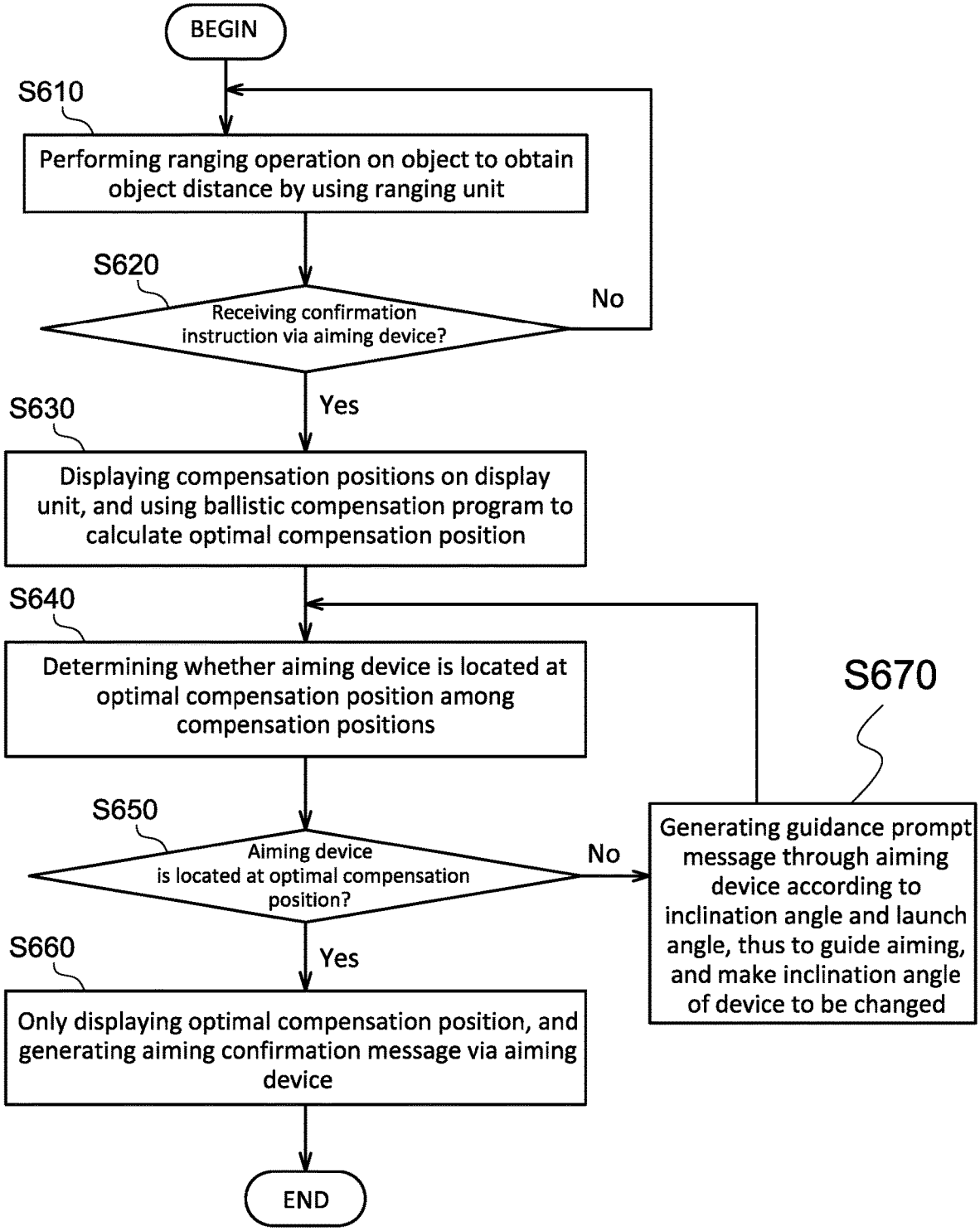
FIG. 6 is a flowchart of another embodiment of an aiming method of the invention.

FIG. 6 shows an aiming method according to another embodiment of the present invention. The aiming method according to the embodiment of the present invention is applicable to the aiming device as shown in FIG. 1. It is noted that, the aiming device can be detachably fixed on a shooting device.

First, in step S610, a ranging unit is used to perform a ranging operation on an object to obtain an object distance from the ranging unit/aiming device to the object. Similarly, in some embodiments, the ranging unit can be a laser ranging module, a transmitting module of the laser ranging module can emit a measurement beam, and the measurement beam can be reflected by a target object to a receiving module of the laser ranging module. Based on the time of emitting laser light and the time of receiving reflected laser light, a distance measurement formula can be used to calculate the distance between the ranging unit and the target object. In step S620, it is determined whether the aiming device receives a confirmation instruction. Similarly, the confirmation instruction can be used to indicate that the aiming device is indeed aiming at this specific object. When the aiming device does not receive the confirmation instruction (No in step S620), the operation of step S610 is continued. When the aiming device receives the confirmation instruction (Yes in step S620), in step S630, a plurality of compensation positions are displayed on the display unit, and a ballistic compensation program is used to calculate a target position/optimal compensation position among the compensation positions based on the object distance. It should be noted that, in some embodiments, the compensation positions may have a plurality of different distance values from a center line of the display unit. Similarly, in some embodiments, the target position/optimal compensation position can be calculated using a ballistic compensation program based on the object distance from the corresponding ranging unit/aiming device to the object, a muzzle velocity of the shooting device, and a gravity. As mentioned above, the aiming device is detachably fixed on the shooting device. Then, in step S640, it is determined whether the aiming device is located at the target position/optimal compensation position among the compensation positions. When the aiming device is located at the target position/optimal compensation position among the compensation positions (Yes in step S650), as in step S660, the display unit will only display the target position/optimal compensation position among the compensation positions or no longer performs the compensation, and an aiming confirmation message is generated via the aiming device. Similarly, in some embodiments, the aiming confirmation message is used to indicate that the aiming device has correctly aimed at the object. In some embodiments, the aiming confirmation message may include lighting of the target position/optimal compensation position and the corresponding object distance. Similarly, in some embodiments, the display unit no longer performs the correction/compensation when the aiming device is in the target position/optimal compensation position. When the aiming device is not located at the target position/optimal compensation position among the compensation positions (No in step S650), in step S670, a guidance prompt message is generated through the aiming device according to an inclination angle and a launch angle, thus to guide aiming, and make the inclination angle of the device to be changed. As a reminder, users can modify the height or angle of the shooting device based on the guidance prompt message. It is noted that, in some embodiments, the guidance prompt message may be any information displayed in the display unit of the aiming device. After that, the process returns to step S640.

Note that, in addition to displaying information through the display unit, in some embodiments, the aiming confirmation message may also comprise a sound through a sound unit. When the user sees/hears the aiming confirmation message, he or she will know that the object has been targeted and can press the shooting/launching command.

Figure 7:
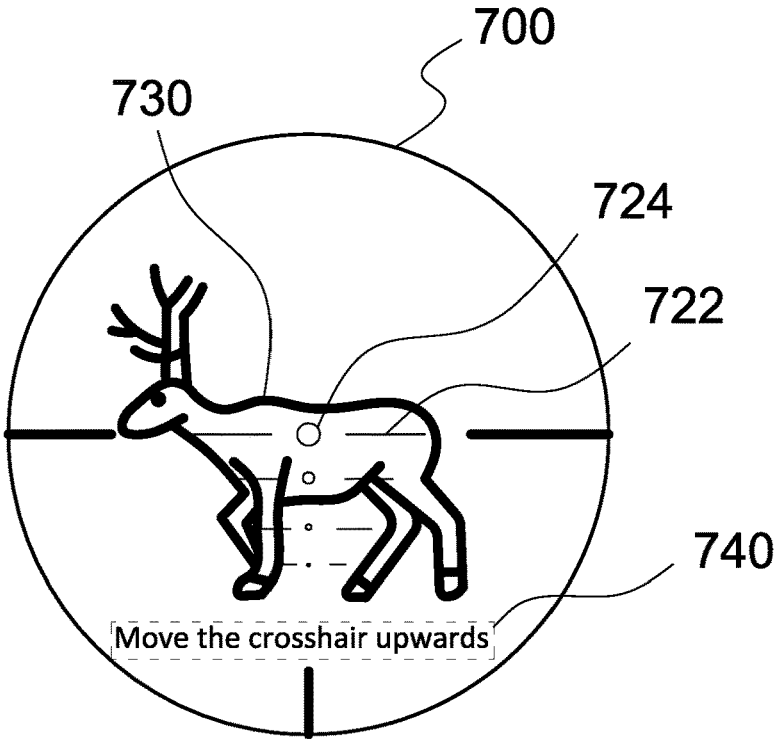
FIGS. 7 and 8 are schematic diagrams illustrating an embodiment of aiming examples of the invention.
Figure 8:
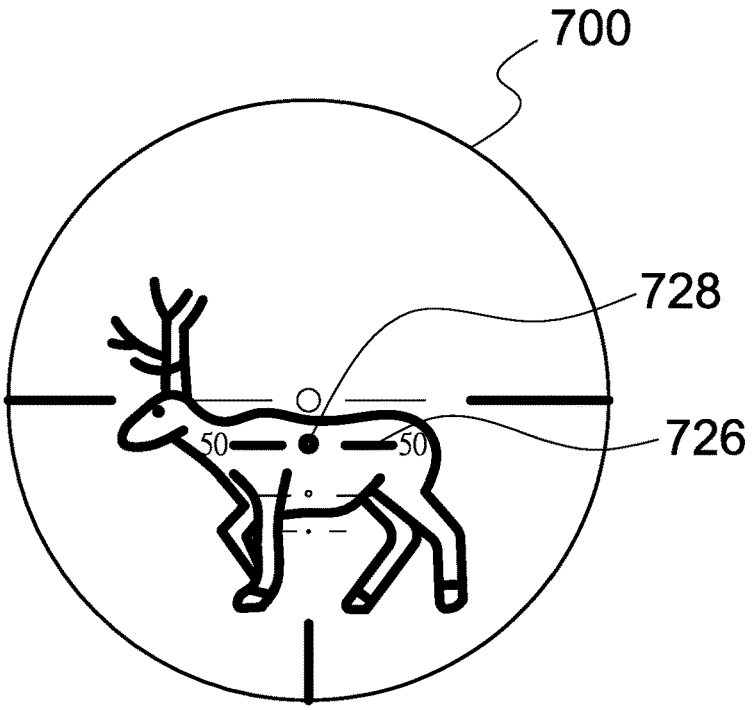

FIGS. 7 and 8 are schematic diagrams illustrating an embodiment of aiming examples of the invention.

In this example, the user can aim at an object, such as the Sambar 730, using an aiming device that is detachably attached to the crossbow. At this time, a display unit 700 of the aiming device can display the sambar 730 and related compensation positions, such as the markings 722 and the crosshair mark 724. As shown in the FIG. 7, each of the compensation positions has a different distance value from a center line of the display unit. When the device is turned on, the device will automatically measure the distance of objects in the environment. When the user issues a confirmation instruction, the aiming device can obtain the distance measurement results of a specific object, such as the object distance from the aiming device to the Sambar 730, and calculate the optimal compensation position. When the aiming device is not in the optimal compensation position, the display unit 700 can display a guidance prompt message 740 to guide the user to adjust up or down the angle of the crossbow. When the aiming device is in the optimal compensation position, the aiming device can generate an aiming confirmation message through the display unit 700. In this example, the aiming confirmation message may include lighting of a specific scale line 726 and a specific crosshair mark 728, and displaying the corresponding object distance. When the user sees this aiming confirmation message, they will know that they have aimed at the object and can press the shooting/launching command.

Therefore, the aiming devices and methods of the present invention can utilize a rangefinder to measure the target distance, and calculate the correct launch angle based on the muzzle velocity of the shooting device. At the same time, through the guidance function, the user can be guided to adjust the inclination angle of the aiming device/shooting device to the correct launch angle to hit the target quickly and accurately. It is noted that, after the aiming device is turned on, it can first scan the distance values of the possible targets. After the user issues a confirmation instruction to the real target, the distance value of the target is obtained and calculated for the required offset, providing faster and more intuitive shooting experiences.

Aiming methods, may take the form of a program code (i.e., executable instructions) embodied in tangible media, such as floppy diskettes, CD-ROMS, hard drives, or any other machine-readable storage medium, wherein, when the program code is loaded into and executed by a machine, such as a computer, the machine thereby becomes an apparatus for executing the methods. The methods may also be embodied in the form of a program code transmitted over some transmission medium, such as electrical wiring or cabling, through fiber optics, or via any other form of transmission, wherein, when the program code is received and loaded into and executed by a machine, such as a computer, the machine becomes an apparatus for executing the disclosed methods. When implemented on a general-purpose processor, the program code combines with the processor to provide a unique apparatus that operates analogously to application specific logic circuits.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalent.

What is claimed is:

1. An aiming method for use in an aiming device, comprising:

performing a ranging operation on an object to obtain a corresponding object distance by using a ranging unit;

displaying a plurality of compensation positions on a display unit of the aiming device, and calculating a target position among the compensation positions according to the object distance by using a ballistic compensation program;

when the aiming device moves, changing the number of the compensation positions displayed on the display unit, and determining whether the aiming device is located at the target position; and when the aiming device is at the target position, only displaying the target position among the compensation positions on the display unit, or no longer performing the compensation via the display unit.

2. The aiming method of claim 1, wherein the compensation positions respectively have a plurality of different distance values from a center line of the display unit, and when the aiming device is located at the target position, the method further comprising a step of generating an aiming confirmation message through the aiming device.

3. The aiming method of claim 1, wherein the aiming confirmation message comprises lighting of the target position and the corresponding object distance, and a shooting device comprises a crossbow, and the aiming device is a laser rangefinder detachably fixed on the crossbow.

4. The aiming method of claim 1, wherein the method for determining whether the aiming device is located at the target location comprises:

calculating a launch angle based on the object distance, a muzzle velocity of a shooting device, and a gravity by using the ballistic compensation program, wherein the aiming device is fixed on the shooting device;

detecting an inclination angle of the aiming device by using an angle detector;

determining whether the inclination angle matches the launch angle; and when the inclination angle matches the launch angle, determining that the aiming device is located at the target position.

5. The aiming method of claim 4, further comprising when the aiming device is not located at the target position, generating a guidance prompt message through the aiming device based on the inclination angle and the launch angle to guide the aiming device to change the inclination angle.

6. The aiming method of claim 1, further comprising:

receiving a confirmation instruction corresponding to the object by utilizing the aiming device; and in response to the confirmation instruction, determining the object distance, wherein the confirmation instruction is received by pressing a button on the aiming device, or is received by the aiming device wirelessly from a remote control.

7. The aiming method of claim 1, further comprising:

providing a plurality of candidate muzzle velocities corresponding to a plurality of candidate shooting devices in the aiming device; and selecting one of the candidate shooting devices to determine the corresponding muzzle velocity for use in the calculation of the launch angle in the 5 ballistic compensation program.

8. An aiming method for use in an aiming device, comprising:

performing a ranging operation on an object to obtain a corresponding object distance by using a ranging unit;

displaying a plurality of compensation positions on a display unit of the aiming device, and calculating a target position among the compensation positions according to the object distance by using a ballistic compensation program;

when the aiming device moves, changing the number of the compensation positions displayed on the display unit, and determining whether the aiming device is located at the target position; and when the aiming device is at the target position, no longer performing the compensation via the display unit.

9. The aiming method of claim 8, wherein the compensation positions respectively have a plurality of different distance values from a center line of the display unit, and when the aiming device is located at the target position, the method further comprising a step of generating an aiming confirmation message through the aiming device.

10. The aiming method of claim 8, wherein the aiming confirmation message comprises lighting of the target position and the corresponding object distance, and a shooting device comprises a crossbow, and the aiming device is a laser rangefinder detachably fixed on the crossbow.

11. The aiming method of claim 8, wherein the method for determining whether the aiming device is located at the target location comprises:

calculating a launch angle based on the object distance, a muzzle velocity of a shooting device, and a gravity by using the ballistic compensation program, wherein the aiming device is fixed on the shooting device;

detecting an inclination angle of the aiming device by using an angle detector;

determining whether the inclination angle matches the launch angle; and when the inclination angle matches the launch angle, determining that the aiming device is located at the target position.

12. The aiming method of claim 11, further comprising when the aiming device is not located at the target position, generating a guidance prompt message through the aiming device based on the inclination angle and the launch angle to guide the aiming device to change the inclination angle.

13. The aiming method of claim 8, further comprising:

receiving a confirmation instruction corresponding to the object by utilizing the aiming device; and in response to the confirmation instruction, determining the object distance, wherein the confirmation instruction is received by pressing a button on the aiming device, or is received by the aiming device wirelessly from a remote control.

14. The aiming method of claim 8, further comprising:

providing a plurality of candidate muzzle velocities corresponding to a plurality of candidate shooting devices in the aiming device; and selecting one of the candidate shooting devices to determine the corresponding muzzle velocity for use in the calculation of the launch angle in the ballistic compensation program.

15. An aiming device, comprising:

a display unit;

a ranging unit performing a ranging operation on an object to obtain a corresponding object distance; and a processing unit displaying a plurality of compensation positions on the display unit, calculating a target position among the compensation positions according to the object distance by using a ballistic compensation program, when the aiming device moves, changing the number of the compensation positions displayed on the display unit, and determining whether the aiming device is located at the target position, and when the aiming device is at the target position, only displaying the target position among the compensation positions on the display unit or no longer performing the compensation via the display unit.

16. The aiming device of claim 15, wherein the compensation positions respectively have a plurality of different distance values from a center line of the display unit, and when the aiming device is located at the target position.

17. The aiming device of claim 15, when the aiming device is located at the target position, the method further comprising a step of generating an aiming confirmation message through the aiming device.

18. The aiming device of claim 15, wherein the aiming confirmation message comprises lighting of the target position and the corresponding object distance.

19. The aiming device of claim 15, wherein a shooting device comprises a crossbow, and the aiming device is a laser rangefinder detachably fixed on the crossbow.

20. An aiming device, comprising:

a display unit;

a ranging unit performing a ranging operation on an object to obtain a corresponding object distance; and a processing unit displaying a plurality of compensation positions on the display unit, and calculating a target position among the compensation positions according to the object distance by using a ballistic compensation program, when the aiming device moves, changing the number of the compensation positions displayed on the display unit, and determining whether the aiming device is located at the target position, and when the aiming device is at the target position, no longer performing the compensation via the display unit.

* * * * *